US006886183B2

(12) United States Patent
DeHaan et al.

(10) Patent No.: US 6,886,183 B2
(45) Date of Patent: May 3, 2005

(54) GOGGLE AND MASK SYSTEM

(75) Inventors: Dave DeHaan, San Diego, CA (US); Bryon Benini, Cardiff by the Sea, CA (US)

(73) Assignee: Dye Precision, Inc., San Diego, CA (US)

( * ) Notice: Subject to any disclaimer, the term of this patent is extended or adjusted under 35 U.S.C. 154(b) by 230 days.

(21) Appl. No.: 10/242,906

(22) Filed: Sep. 13, 2002

(65) Prior Publication Data

US 2004/0049825 A1 Mar. 18, 2004

(51) Int. Cl.[7] ..... F41H 1/04
(52) U.S. Cl. ..... 2/6.7
(58) Field of Search ..... 2/9, 427, 431, 2/6.7

(56) References Cited

U.S. PATENT DOCUMENTS 4,653,124 A * 3/1987 McNeal et al. ..... 2/427
D317,063 S * 5/1991 Johnson ..... D29/110
5,018,223 A * 5/1991 Dawson et al. ..... 2/436
5,564,132 A * 10/1996 Kuo ..... 2/430
5,642,530 A * 7/1997 Parks ..... 2/435
5,657,493 A * 8/1997 Ferrero et al. ..... 2/428
6,029,271 A * 2/2000 Banuchi ..... 2/9
6,105,177 A * 8/2000 Paulson et al. ..... 2/431
6,381,749 B1 * 5/2002 Cyr ..... 2/9
6,560,788 B1 * 5/2003 Beltrani ..... 2/428
2003/0159199 A1 * 8/2003 Broersma ..... 2/423
2004/0103469 A1 * 6/2004 Hussey ..... 2/436

OTHER PUBLICATIONS

Dye '04 Invision Mask, www.piratepaintball.com.*

Dye Invision Paintaball Mask , www.directpaintball.com.*

* cited by examiner

*Primary Examiner*—Katherine M Moran
(74) *Attorney, Agent, or Firm*—Richard D. Clarke

(57) ABSTRACT

A goggle having a frame and lens assembly, a mask attached to the goggle assembly, and a strap securing member.

19 Claims, 16 Drawing Sheets

GOGGLE AND MASK SYSTEM

FIELD OF THE INVENTION

The present invention relates to a protective goggle and to a goggle in combination with a mask for playing paintball.

BACKGROUND OF THE INVENTION

Numerous patents have proposed various systems for protecting the eyes and face of a person in environments and situations in which the person is at risk for injury to the eyes or face from impact by paintballs, or the like. These systems typically have a goggle designed to protect the eye and some have additional mask elements to protect the face of the wearer. Most goggle or goggle-mask combinations have problems in at least one of the following areas: leakage or splash-through the lens/frame contact or through the mask with high velocity impact of paintballs; difficulty of assembly and disassembly for cleaning; sub-optimal vision through the lens; sub-optimal ventilation through the entire mask; sub-optimal comfort. The present invention addresses these disadvantages described above through its flexible and secure design.

SUMMARY OF THE INVENTION

The present invention includes a device which is a goggle having a frame and lens assembly, a mask attached to the goggle assembly, and a strap securing member.

The goggle frame and lens assembly provides extreme flexibility, secure assembly, a smooth outer surface, excellent vision, disassembly for cleaning, comfort and ventilation. The extreme flexibility comes from the resilient, flexible material used in the construction of the goggle frame. The secure assembly and disassembly is provided by the tab retention system including a plurality of tabs and mating tab retention holes, a central stability tab and a flush fit between the tabs and the goggle frame when the lens is secured within the front gutter of the frame. Because of the overall lens and frame design, the user's eyes are safe, and the goggle frame and lens are secure even when an object hits the goggle at a high impact. Ventilation is provided by air holes through the rear gutter of the frame. The comfort is provided through the three stage foam disposed on the inner surface of the goggle frame. The lens contour provides superior peripheral vision because of the multiple radii design.

The mask is conveniently attached or detached from the goggle frame for cleaning, provides superior ventilation through the plurality of vents, and is designed with a comfortable fit for extended wear on a persons face. The mask is attachable to the goggle frame and includes a main portion and an ear portion as a part of the mask. The main portion includes a plurality of vents, some of which have a plurality of vanes formed therein. The vents are designed to allow multi-directional airflow to increase ventilation as well as voice transmission through the mask. The resilient, flexible material and foam disposed on the ear portion of the mask provide excellent comfort and feel for extended wear.

DRAWINGS

DETAILED DESCRIPTION OF THE PREFERRED EMBODIMENTS

Figure 1:
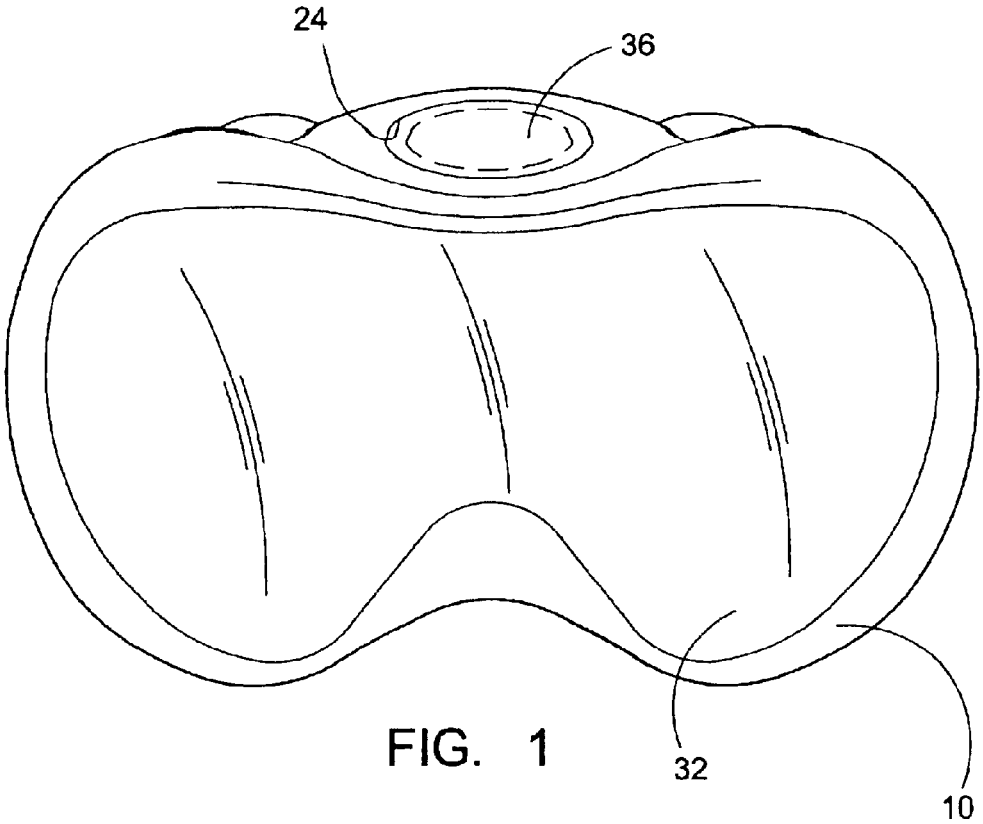
FIG. 1 is a front view of the frame of the present invention.
Figure 2:
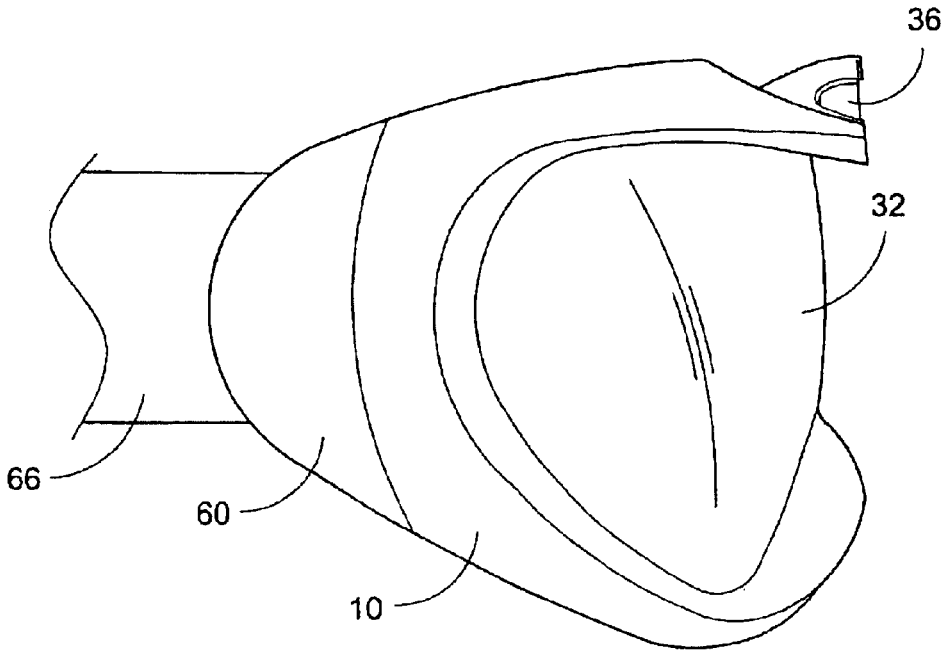
FIG. 2 is a side view of the frame of the present invention.

The device 1 of the present invention comprises a goggle lens and frame assembly as shown in FIG. 1 and FIG. 2. The goggle frame 10 is designed as will be described in the following paragraphs with a front and rear gutter. The front gutter of the frame is designed to securely hold the lens 32.

In a preferred embodiment, the device 1 further comprises a protective mask (FIG. 13) and will also include a strap securing member 60 and a strap 66. The strap securing member may be formed integrally with the frame 10 or may be formed as a separate member that cooperates with the frame designed to be mated thereto.

Figure 3:
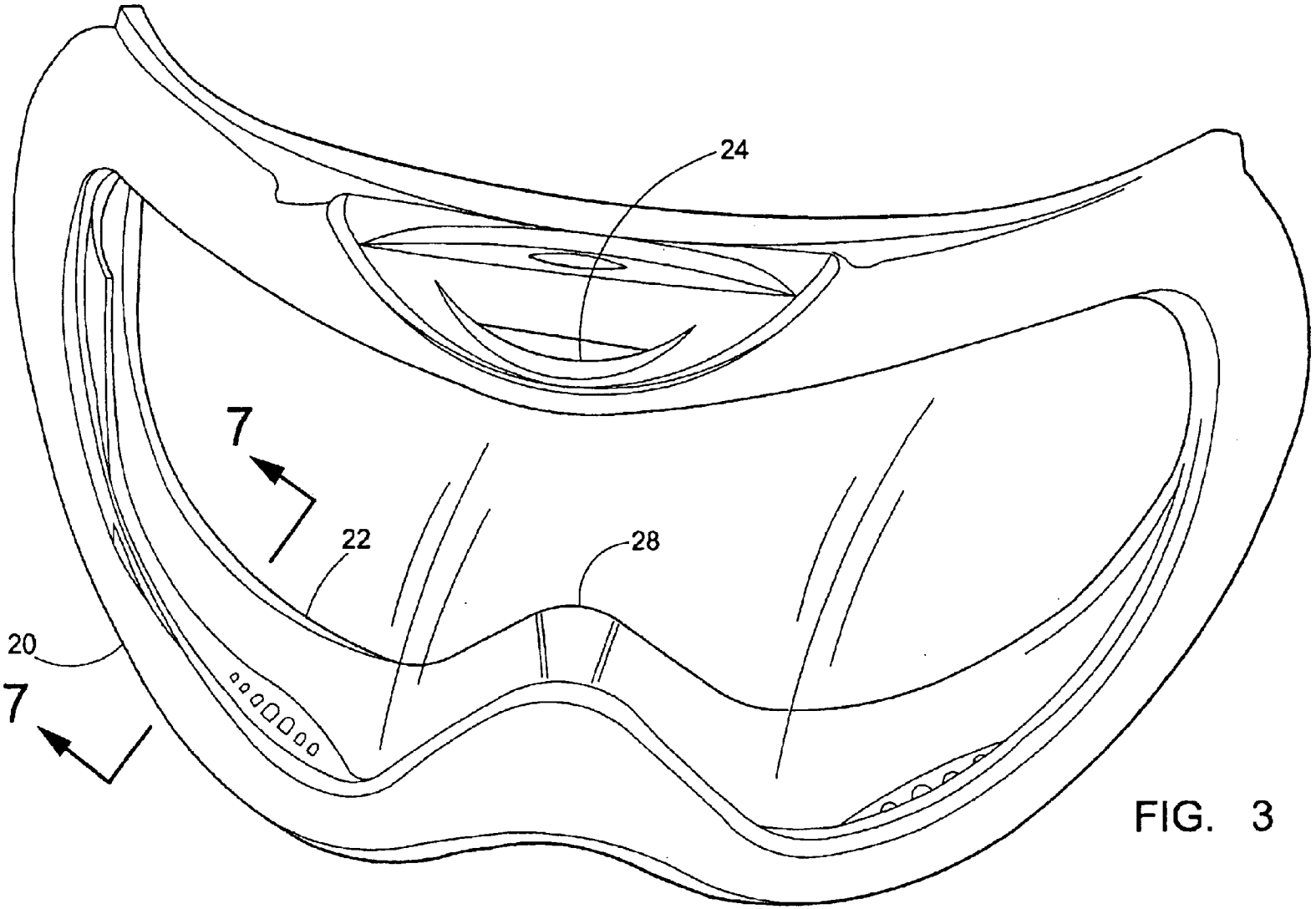
FIG. 3 is a perspective view of the front of the frame of the present invention.

The frame 10, shown in FIG. 3 reveals the central stability tab retention hole 24, which is designed for increasing the security and stability of the lens and frame when the lens is received in the frame. The central stability tab retention hole 24 provides a larger hole for receiving the larger central stability tab 36, shown in FIG. 8. The nose portion 28 of the frame 10 exemplified here will be described with regard to its functionality along with the method for inserting the lens into the frame. The perspective view of the front of the frame 10 reveals the rear gutter 22, which will be described in greater detail in accordance with FIG. 6 and FIG. 7.

Figure 4:
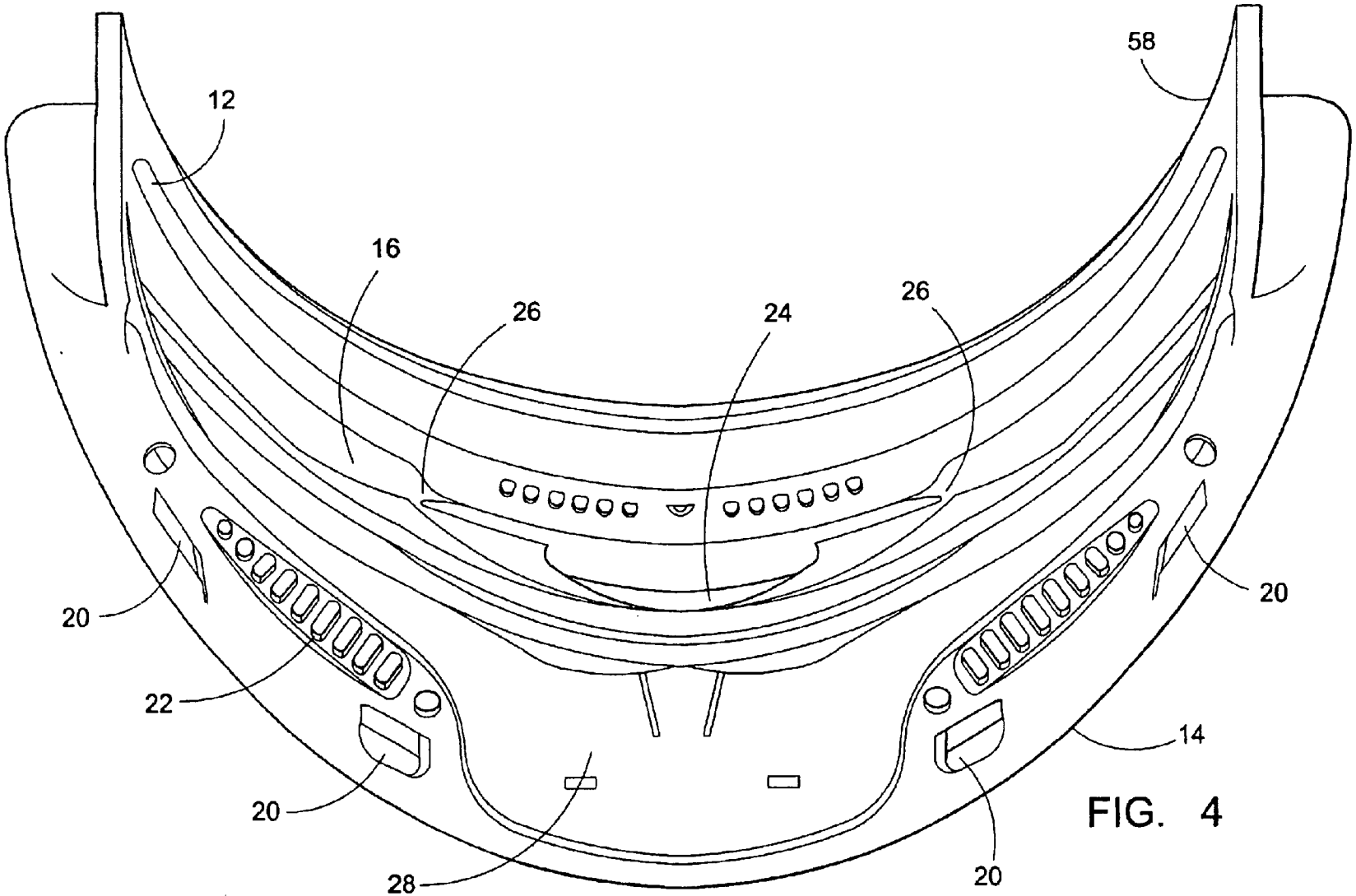
FIG. 4 is a perspective view of the bottom of the frame of the present invention.
Figure 8:
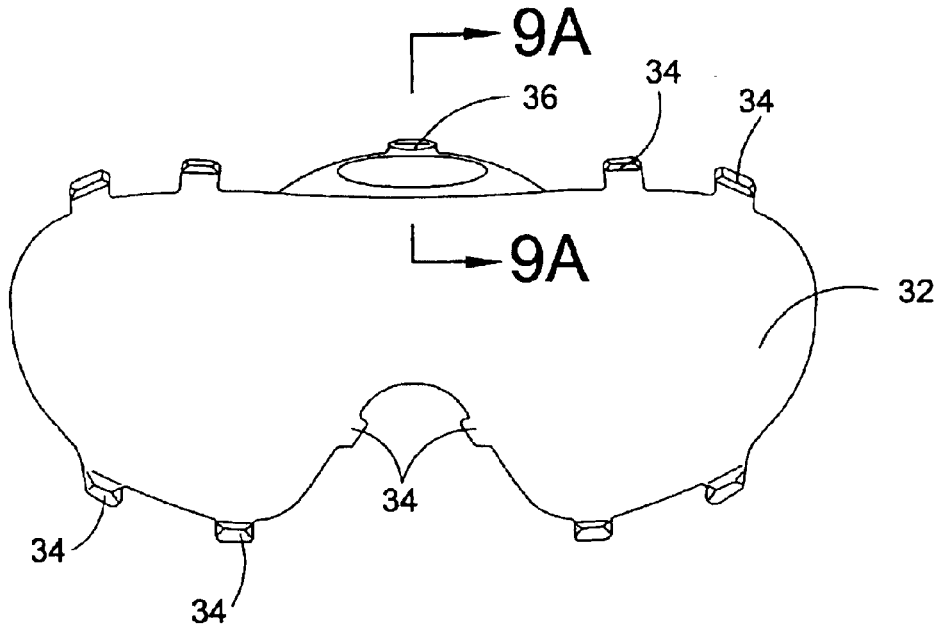
FIG. 8 is a perspective view of the front of the lens of the present invention.

The perspective view from the bottom of the frame 10 (FIG. 4) reveals a plurality of tab retention holes 20 that are designed (i.e. shaped and dimensioned) to receive a plurality of tabs 34, shown in FIG. 8, for securely receiving the lens 32 into the frame 10. It can be seen that the inner side 12 of the frame 10 is shaped to fit onto the face, around the eyes of the user and the outer side 14 of the frame 10 is designed to conform to the user's face without unnecessary obstruction. The plurality of air holes 22 allow air to flow through the frame for the user's additional comfort and to increase ventilation within the frame. The frame is preferably molded from tear resistant polyurethane, however any flexible, resilient material could be used as would be known by one of ordinary skill in the art. By providing flexibility and resilience in the frame 10, the frame is more likely to stay securely on the face of a person, even when hit with external objects, such as a paint ball. Stability ribs 58 are placed perpendicular to the inner wall and side walls of the frame, connecting the inner walls of the rear gutter, providing additional stability to the resilient frame thereby reducing failure of the frame to hold its proper shape.

Figure 5:
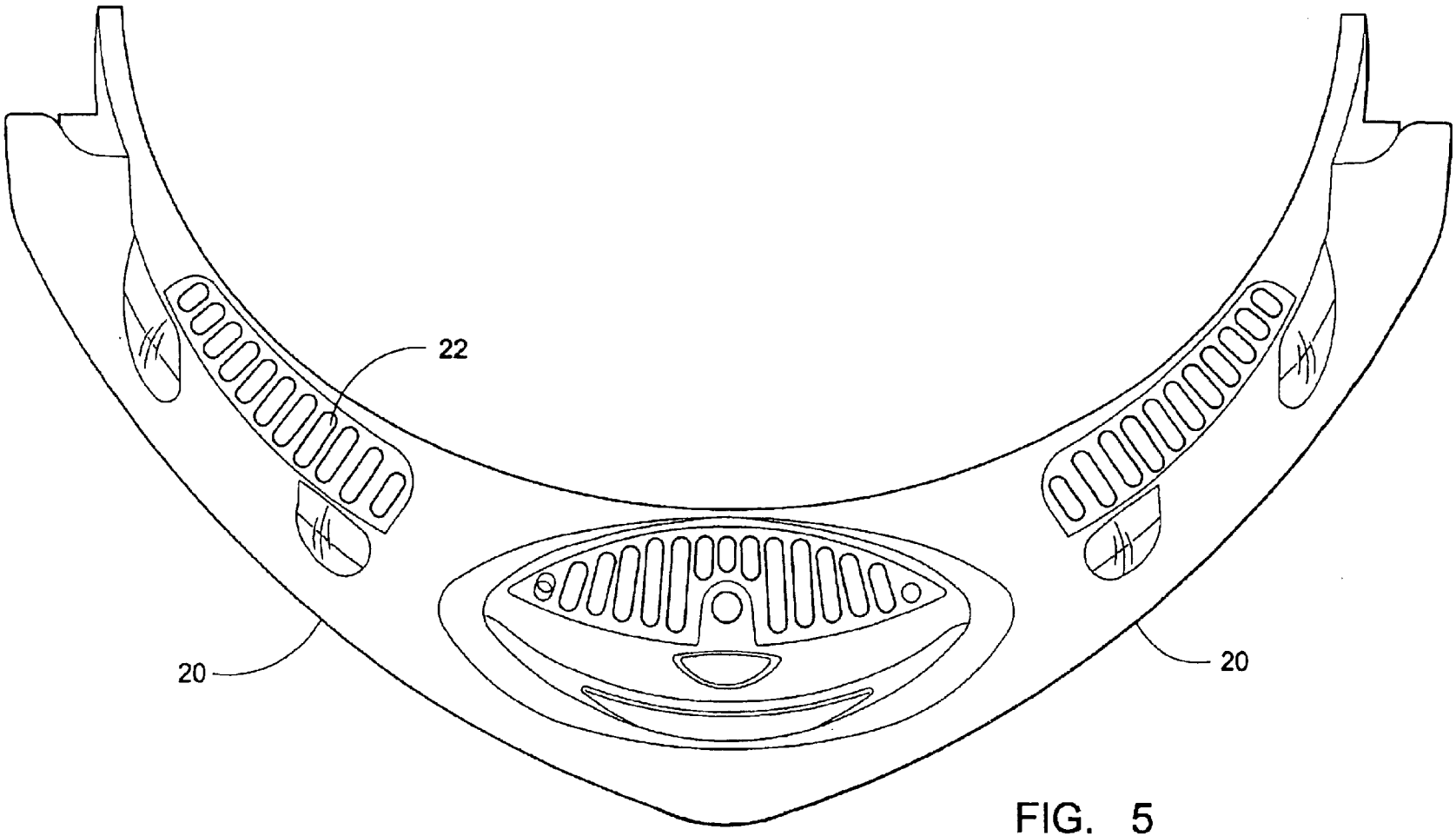
FIG. 5 is a perspective view of the top of the frame of the present invention.

The top view of the frame in FIG. 5 reveals the tab retention holes 20 designed to receive the retention tabs 34 as will be described in accordance with FIG. 6 and FIG. 7. The air holes 22 that extend through the rear gutter 18 are additionally formed on the top side of the frame for additional air flow into and out of the frame when worn by a person.

Figure 6:
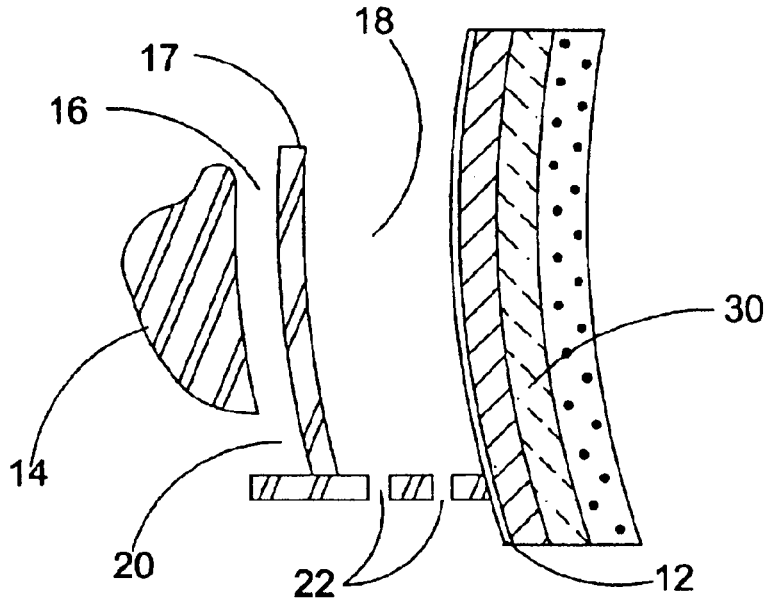
FIG. 6 is a cross-sectional view of the frame taken along line 1—1 of FIG. 3.

FIG. 6 shows a cross sectional view taken along the bottom portion of the frame, line 1—1 of FIG. 3. An upright member 17 formed in the inner circumference of the frame 10 forms a front gutter 16 and a rear gutter 18 for providing excellent security of the lens 32 within the frame, while also providing enhanced air flow from the inside of the frame to the outside of the frame when worn by a person. The front gutter 16 extends substantially around the inner circumference of the frame 10 and is particularly designed to receive the lens as shown in FIG. 7. The front gutter 16 also includes a plurality of tab retention holes 20 for securely receiving a plurality of retention tabs 34 on the lens 32 into the frame 10. The rear gutter 18 extends substantially around the circumference of the frame 10 and is particularly designed with air holes 22 to allow the flow of air into and out of the frame when worn by a person.

Figure 7:
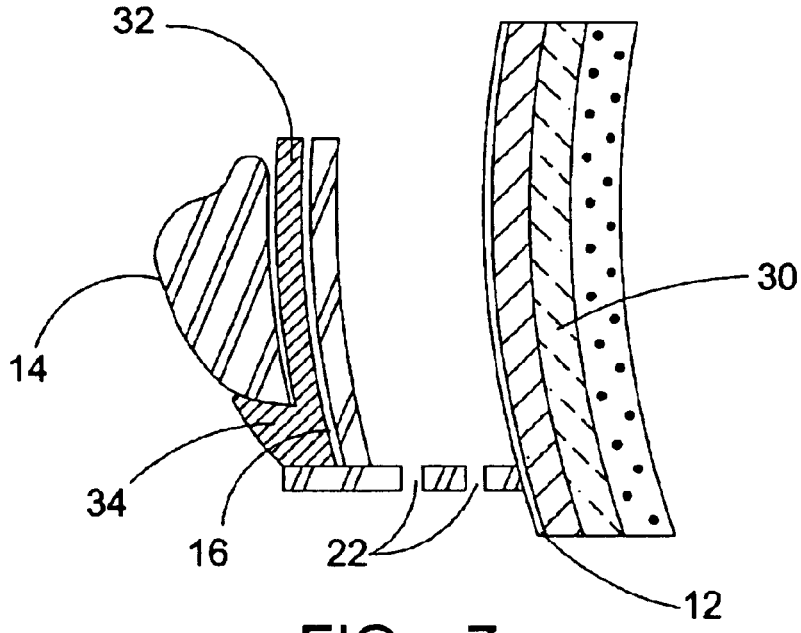
FIG. 7 is a cross-sectional view of the frame taken along line 1—1 of FIG. 3, including the lens inserted in the frame.

FIG. 7, which is similar to FIG. 6, shows the lens 32 with a retention tab 34 secured within a tab retention hole 20 of the goggle frame 10. A cross-section view of the lens and frame assembly reveals that most of the retention tabs 34 have outer surface that lie in the same plane as the outer side 14 of the goggle frame 10 when the lens is inserted into the goggle frame. More specifically, retention tabs 34 are hook-shaped and extend outwards of the convex side of the lens. When the free ends of retention tabs 34 are inserted into the matching tab retention holes 20, the free end come to rest in a position that is flush with goggle frame 10. This flush seating of the retention tabs 34 within the tab retention holes 20 shown in FIG. 7 is important because there are no extruding edges that could cause failure of the effectiveness of the protective mask upon impact of an object, such as a paint ball, onto the frame and lens construction. The insertion of the lens 32 into the front gutter 16 of the frame 10, in combination with the design of the cooperating tabs 34 on the lens 32 and holes 20 on the frame 10 providing a flush fit, allows objects to hit the protective mask, specifically the frame and lens attachment area, without dislodging or allowing leakage of the lens within the frame. The overall frame 10 and lens 32 design delivers safety and a securely locked frame and lens under the most severe head-on and angled impacts.

The means for securing the lens within the frame is shown as a retention tab and hole system, however it should understood that any system of cooperating parts could be used in the present invention to secure the frame and lens together. The cooperating parts may be designed as described in the preferred embodiment or substituted by any means for attaching two parts, including: locking tabs, screws, peg and hole fasteners, snaps, or any other known fastening means. More preferably, the cooperating parts should be mating parts, defined by multiple elements that are dimensioned and arranged to fit together and release using hand manipulation only, that is, without the need for a tool or additional object to aid in the securing and releasing of the attachment.

The inner side 12 of the frame 10 further includes foam. Although any foam could be used here, the preferred embodiment of the protective mask system uses three stage foam combining three different foam materials with three distinctive foam densities. One layer of this foam is designed to wick away sweat and moisture from the face of a person. Another layer is designed to provide a resilient boundary between a person's eyes and perspiration. The final layer is designed to absorb impact energy which will keep the frame from bottoming out on the person's face upon impact on an object to the frame.

The lens 32 is best seen in FIG. 8. A preferred embodiment of the lens 32 includes eleven retention tabs 34. One skilled in the art would understand that adding or removing tabs 34 from the lens periphery would not depart from the spirit of the invention. However, the preferred design of eleven retention tabs, including one central stability retention tab 34 and ten other retention tabs 34 provides an aggressively secured lens and frame construction for maintaining a secure fit in the event of an object impacting the lens and frame at a high force. The preferred material is a polycarbonate, however any equivalent material could be used as would be known by one skilled in the art. It should be understood that any cooperating parts could be used in the present invention to secure the frame and lens together. The cooperating parts may be designed as described in the preferred embodiment or substituted by any means for attaching two parts, including: locking tabs, screws, peg and hole fasteners, snaps, or any other known fastening means. More preferably, the cooperating parts should be mating parts, defined by multiple elements that are dimensioned and arranged to fit together and release using hand manipulation only, that is, without the need for a tool or additional object to aid in the securing and releasing of the attachment.

The central stability retention tab 36 and central stability tab retention hole 24 are designed as cooperating parts for allowing mating between the parts in a secure manner. Upon attachment, the outer surface of the central stability tab 36 lies in the same plane as the plane of the outer surface 14 of the goggle frame 10. This design allows a flush fit of the tab 36 in the hole 24, thereby provided the advantages discussed with regard to the other of the plurality of tabs 34 and retention holes 20 described below. The central stability retention tab 36 and central stability tab retention hole 24 are multi-functional. The greater surface area of attachment between the central stability tab 34 and central stability hole 24 as compared to the other retention tabs 34 and tab retention holes 20, or other tab and hole configurations known in the art, provides greater stability and security of attachment. The central stability retention tab 36 provides grip for inserting the lens into the frame as described with regard to the recommended installation procedure below. Additionally, the outer face or surface 37 of the central stability retention tab 36 provides an excellent position and easy manufacture for ornamental designs, labels, logos or manufacturer advertising.

To install the lens 32 into the frame 10, the following steps are preferred, but not exclusive. Moisten the tabs 34 with water. Grasp the lens 32 by the central stability retention tab 36 with thumb over the outer surface of the central stability tab 36. Pinch the nose portion 28 of the goggle frame 10 and insert the two nose tabs, one on each side of the bridge. Move to the left and insert the two bottom tabs. Use palm pressure on the bottom of the goggle frame to push in the two bottom right tabs. Slide right side of lens into the front gutter. Move the central stability tab hole over the central stability tab without snapping it in. Line up remaining tabs to be inserted. Apply palm pressure to the two tabs on left. Apply palm pressure to the two tabs on right. Use thumb pressure to insert the central stability tab. Check that all tabs are completely inserted into the goggle frame. Tabs may need a final push to completely seat.

Figure 9A:
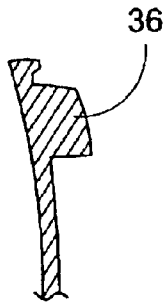
FIG. 9A is a cross-sectional view of the central stability tab taken along line 2—2 of FIG. 6.
Figure 9B:
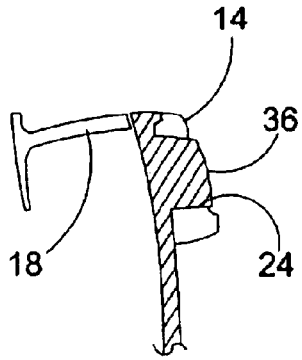
FIG. 9B is a cross-sectional view of the central stability tab similar to FIG. 9A and including the frame of the present invention.

FIG. 9A and FIG. 9B show a cross-section view along line 2—2 of the central stability tab shown in FIG. 8. The central stability tab is designed to fit flush with the outer surface 14 of the frame 10. This flush fit decreases edges and abutments on which an object that is impacting the frame could catch.

Figure 10:
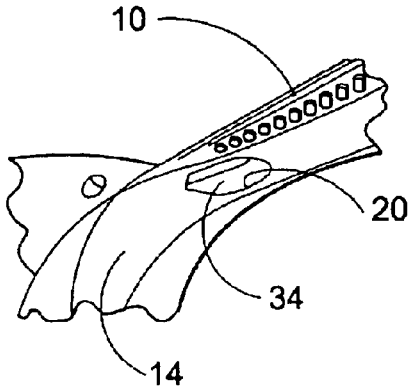
FIG. 10 is a partial fragmentary view of a portion of the frame and the lens and retention tabs attached thereto.

The other retention tabs are designed in a similar matter to the central stability tab. The outer surface of the retention tabs 34 are provided with a curvature and the outer surface 14 goggle frame 10 is also designed with a curvature. The curvature of the tabs and the curvature of the frame are designed to lie in the same plane such that when the tabs 34 are inserted into the tab holes 20, the outer surface of the tabs 34 lie flush against the outer surface 14 of the frame 10 as shown in FIG. 10.

Figure 11:
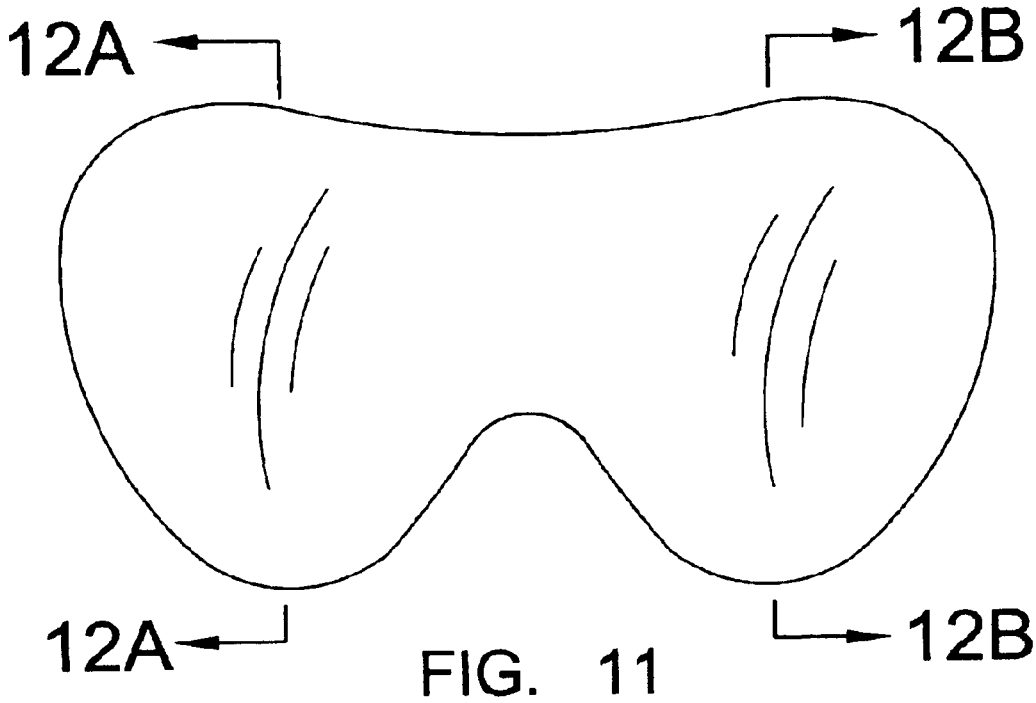
FIG. 11 is a frontal view of the lens of the present invention.
Figures 12A, 12B:
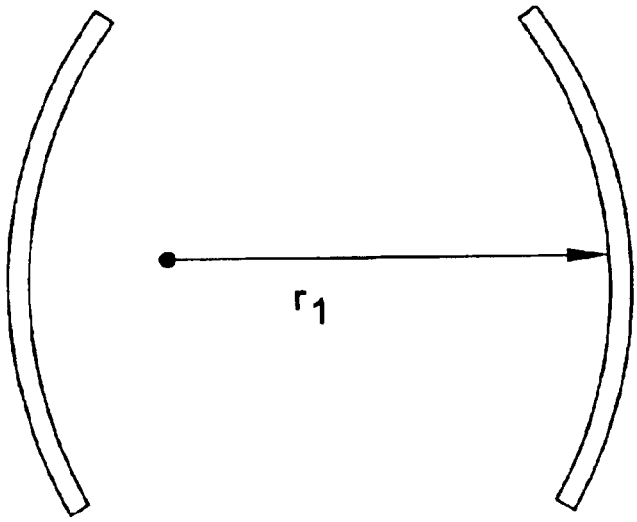
FIGS. 12A and 12B are cross-sectional views taken along line 3—3 and line 4—4.

FIG. 11, FIG. 12A and FIG. 12B all exemplify views of the shape of the lens 32. The lens 32 of the present invention is contoured with multiple radii of curvature. Vertical and horizontal peripheral vision is essential in most activities requiring protective masks. By incorporating multiple radii into the contour of the lens shape, each eye of a person will have a more natural and extended peripheral vision due to the individual radius of curvature in front of each eye on the lens.

In addition to a lens 32 and frame 10 assembly, a preferred embodiment involves a mask 40 (FIG. 13) attached to the frame 10 to form a goggle and mask system. The mask 40 has a main portion 44 and an car portion 46. The main portion and ear portion are shown in the preferred embodiment to be two pieces, however, the ear portion 46 and main portion 44 could be formed as one piece. The mask is manufactured from a resilient, flexible material to allow optimum comfort and shape. The mask 40 includes a plurality of vent holes 48. The vent holes 48 may be of any size, as smaller vent holes shown on the ear portion and areas of the main portion, larger vent holes having a plurality of vanes 50, or a preferably a combination of both. The plurality of vanes 50 are formed within the vent holes 48 as described above and designed at a plurality of angles with respect to the plane of the surface of the main portion 44 to allow multi-directional air flow through the mask 40.

Figure 13:
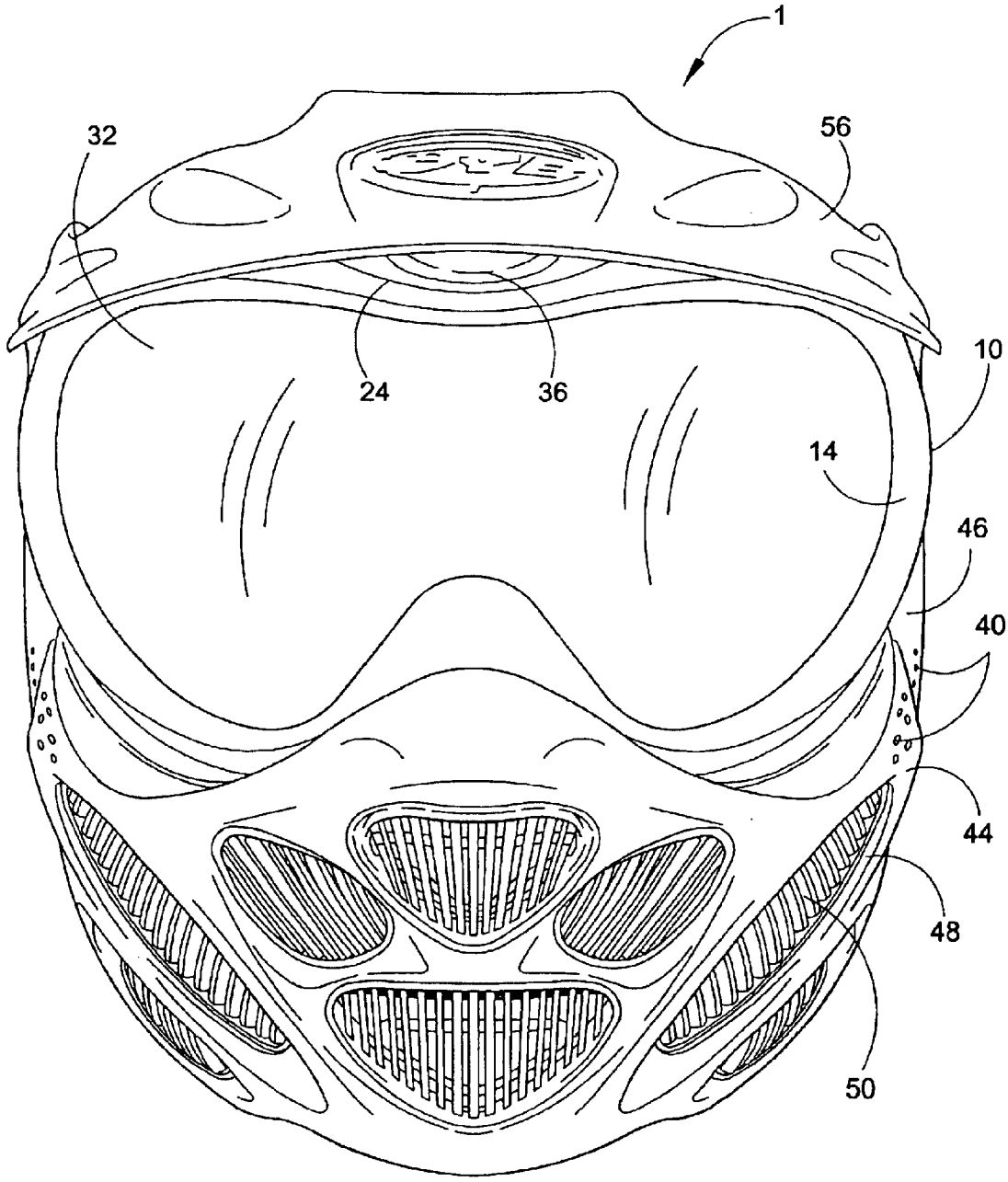
FIG. 13 is a perspective view of the fully constructed protective mask system of the present invention.
Figure 14:
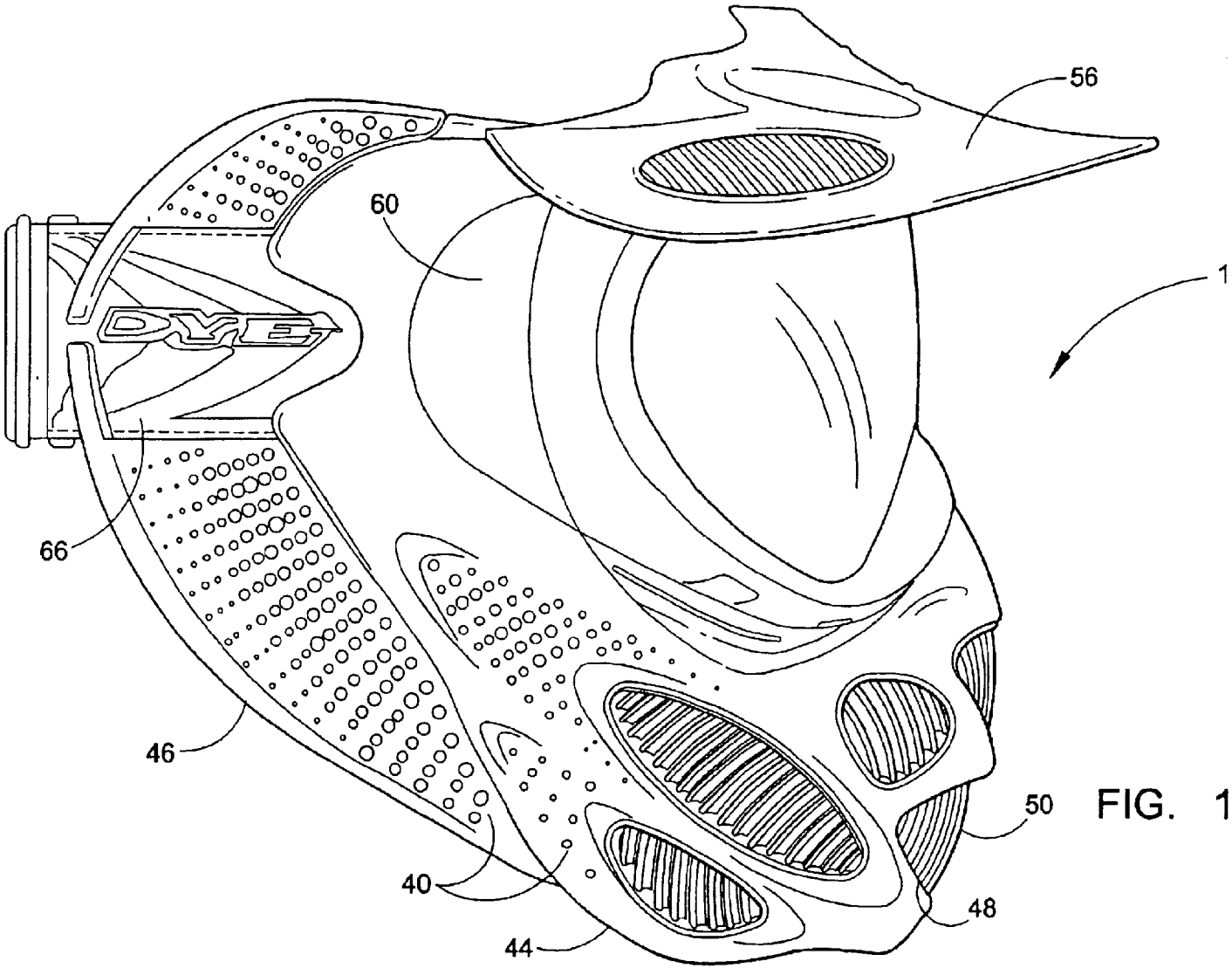
FIG. 14 is perspective view of the side of the fully constructed protective mask system of the present invention.

The preferred embodiment of the goggle and mask system of the present invention is shown in its perspective view in FIG. 13 and FIG. 14. Device 2 comprises the frame 10 having the inner side 12 designed to fit comfortably around the eyes on the face of a user, and the outer side 14 designed with a curvature. The lens 32 is received into and fits securely within the frame 10. The mask 40 is attached the frame 10 and designed to protect extended portions of the person's face, such as the nose, mouth, chin, jaw, temples and ears. The mask 40 could also be designed to protect the throat or other parts of the person. The main portion 44 is designed with a curvature and has an inner surface that is shaped to cover the nose, mouth, chin and jaw areas of the person. The ear portion 46 is designed with a curvature and is shaped to cover the ear area of the person A fully constructed goggle and mask 2 will also include a strap securing member 60 and a strap 66. The strap securing member may be formed integrally with the frame 10 or may be formed as a separate member that cooperates with the frame designed to be mated thereto. Additionally, a person may attach the visor 56 to the top of the frame 10 for providing shade to the person's eyes.

Figure 15:
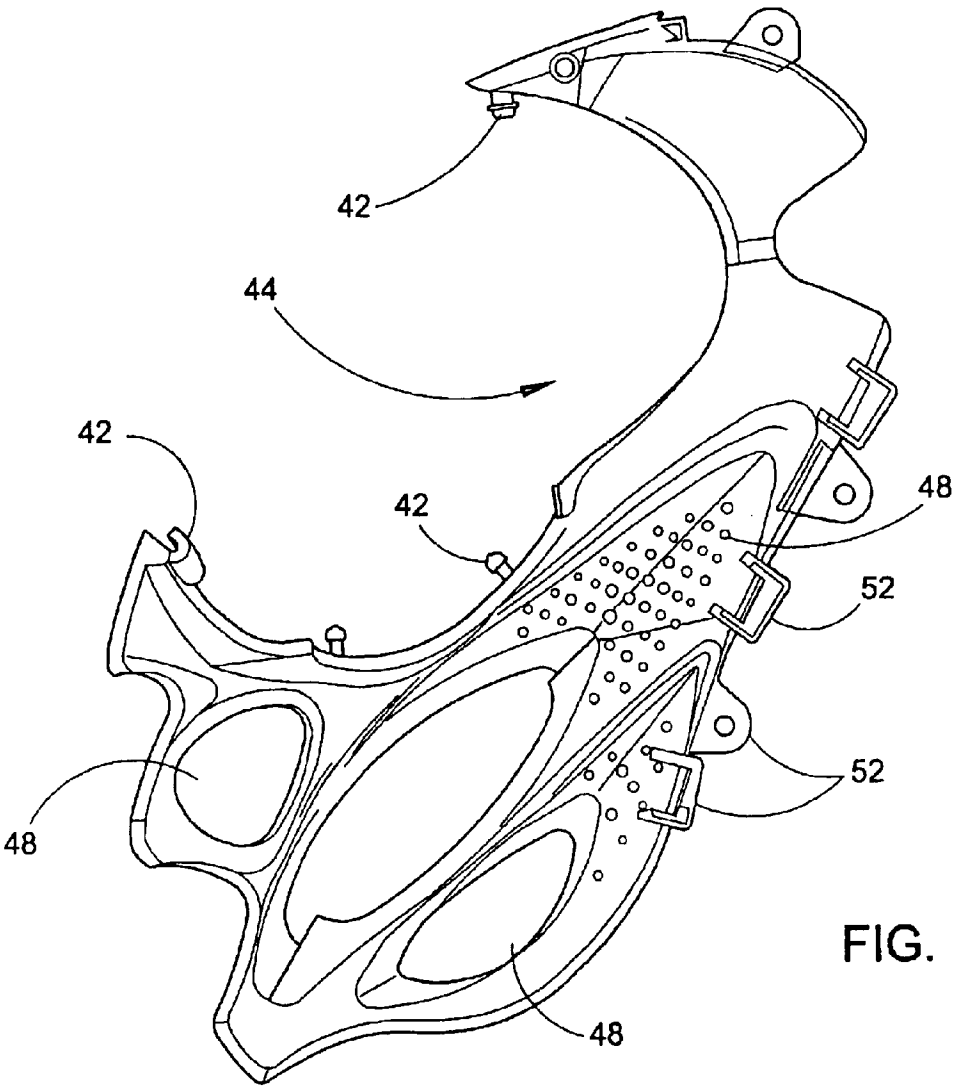
FIG. 15 is a perspective view of the main portion of the mask of the present invention.

The main portion 44 of the mask 40 is designed to cover and protect the nose, mouth, chin, temples and jaw as shown in FIG. 15. The plurality of vents 48, including holes sized to receive the plurality of vanes 50 are shown in FIG. 15. The mask 40 is designed to attach to the frame 10 through a plurality of cooperating parts that are adapted to mate together. It should be understood that any system of cooperating parts could be used in the present invention to secure the mask 40 and lens 32 together. The cooperating parts may be designed as described in the preferred embodiment or substituted by any means for attaching two parts, including: locking tabs, screws, peg and hole fasteners, snaps, or any other known fastening means. More preferably, the cooperating parts should be mating parts, defined by elements that are dimensioned and arranged to fit together and release using hand manipulation only, that is, without the need for a tool or additional object to aid in the securing and releasing of the attachment.

Figure 16A:
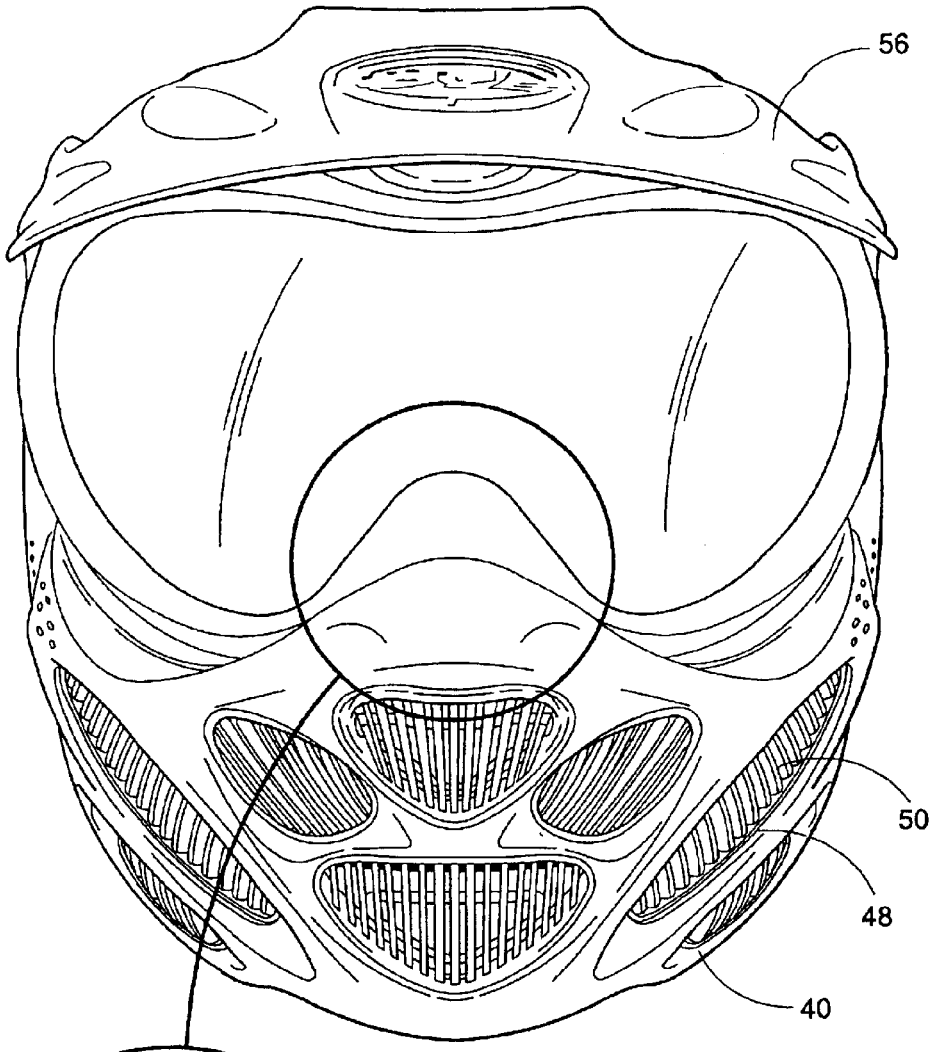
FIG. 16A is a perspective view of the fully constructed protective mask system of the present invention.
Figure 16B:
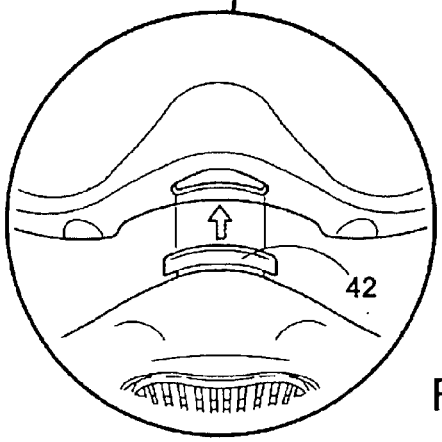
FIG. 16B is an expanded view of a portion of the means for attaching the mask to the frame highlighted in FIG. 14A.

To attach the mask 40 to the frame 10, the following steps are preferred, but not exclusive. Hold the goggle frame 10 in the right hand and the mask 40 in the left hand. Attach the cooperating parts 42 closest to the nose area first as shown in FIG. 16A and FIG. 16B. Continue to work up towards the top of the mask 40, attaching the cooperating parts as one progresses. Inspect the mask attachment carefully. Make sure that there are no gaps between the mask and the goggle frame 10. The attachment of the mask 40 to the frame 10 is designed for a secure fit without any protruding parts to allow maximum security of attachment without leakage upon impact of an object to the mask 40.

Figure 17:
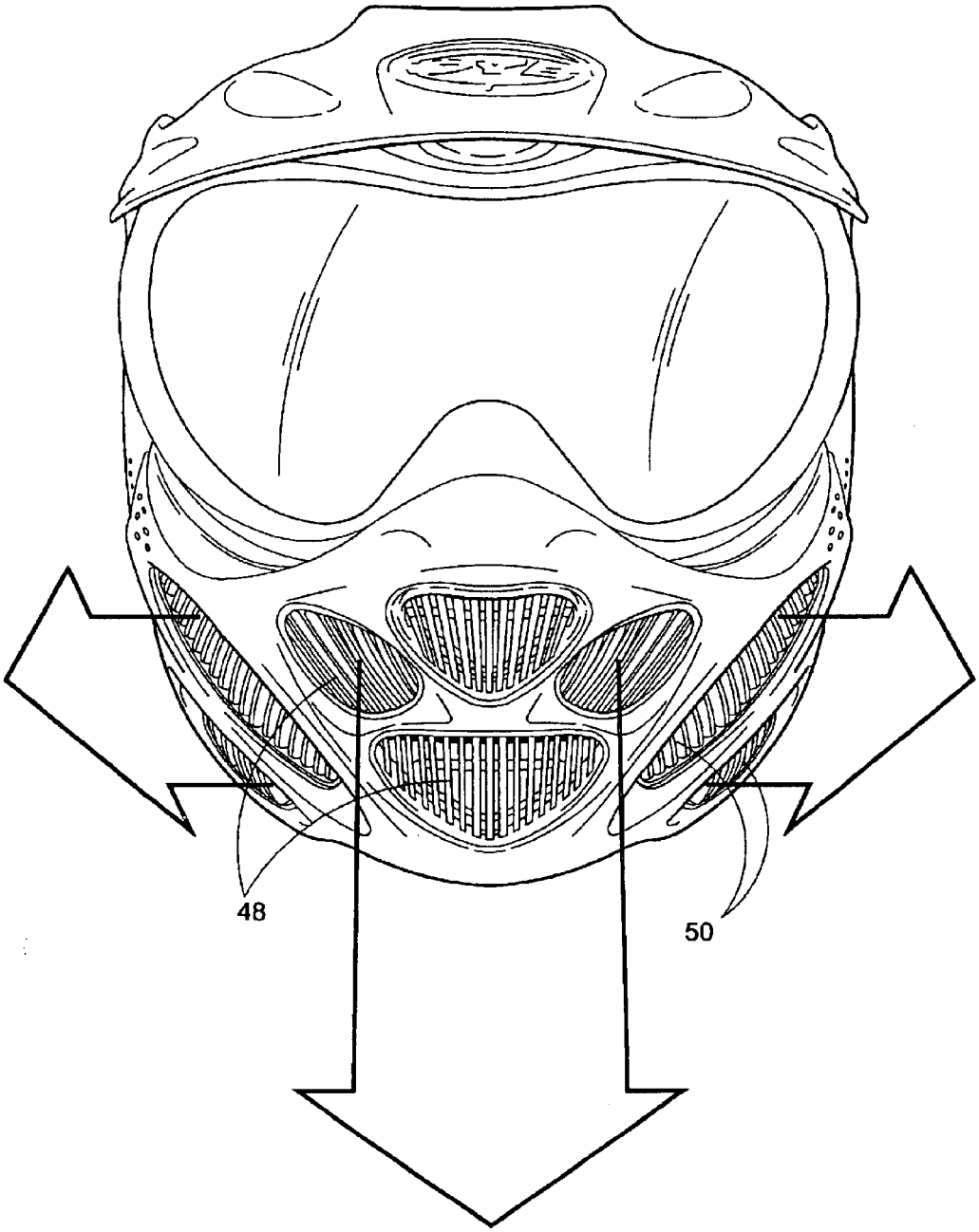
FIG. 17 is a perspective view of the fully constructed protective mask system of the present invention highlighting the direction of airflow through the vents on the mask.
Figure 18:
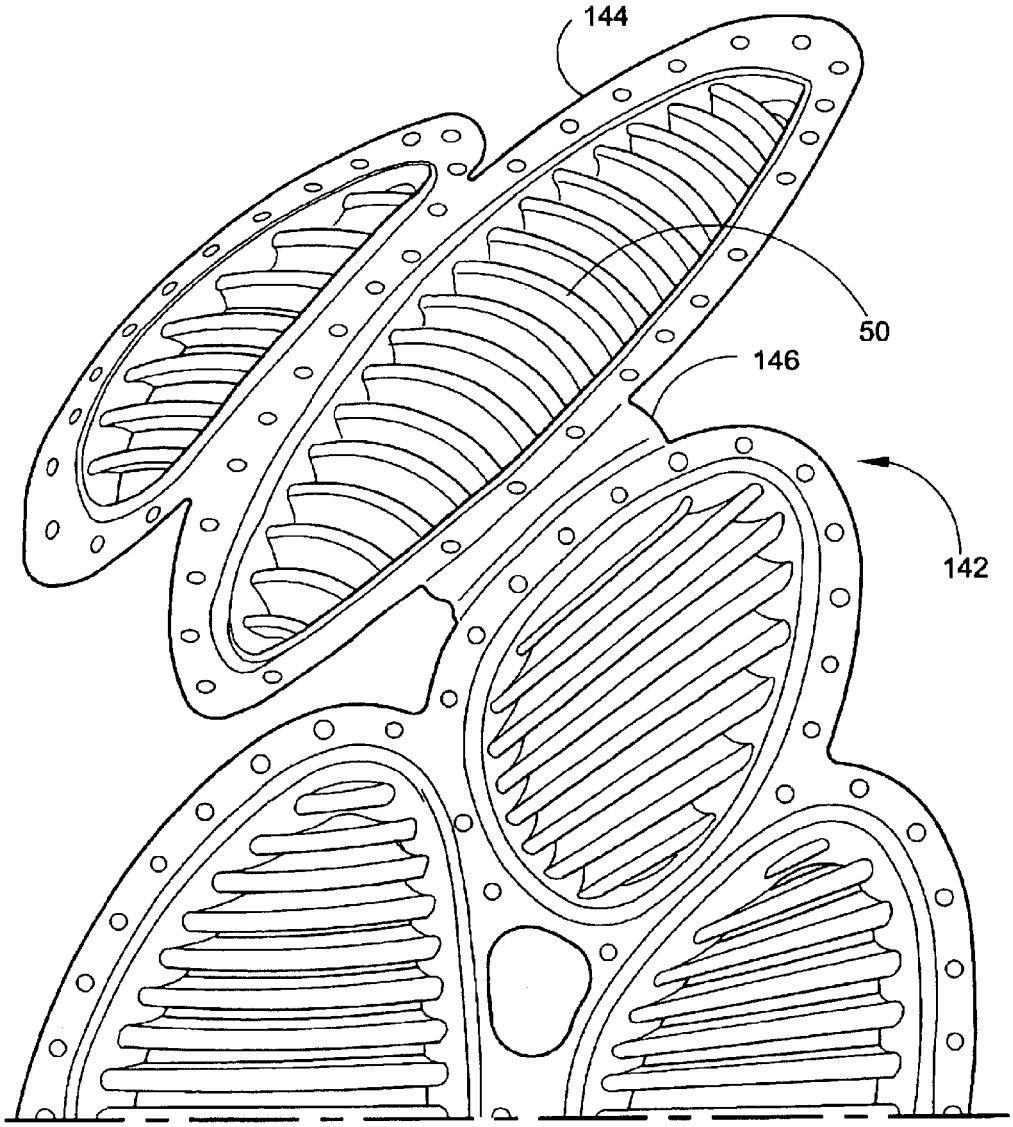
FIG. 18 is an expanded view of the vanes formed within the vents of the mask.

The plurality of vanes 50 disposed within the vents 48 in portions of the mask 40 are specifically designed for multi-directional airflow as indicated on FIG. 17. The side vents 48 project sideways and are particularly designed to encourage airflow through the side of the mask, while the front vents 48 project forward from the nose and mouth regions and are specifically designed to allow airflow through the front of the mask. FIG. 18 exemplifies the specific insert design for the plurality of vanes 50 that allows the multi-directional flow of air through the mask. More specifically, vanes 50 are manufactures in clusters 144 connected by bridge elements 146 to form one or more vanes sheets 142 that are inserted into mask frame 44, depicted in FIG. 15. After mating the vane sheets 142 with mask frame 44, vanes 50 are in a recessed position in relation to the outer surface of mask frame 44, to provide for a sculpted appearance. Of particular importance are the varying angles of the vanes with respect to the plane of the mask 40, when the vanes 50 are disposed within the vents in order to achieve a forward flow of air and voice in the central region of the mask, and a sideways flow in the side regions of the mask. The advantages of this design allow a person's voice to be heard farther away than other venting systems that have simple holes that allow air flow only perpendicular to the mask. Voice communication is essential in certain activities requiring protective masks, such as communicating with teammates during paint ball play. Additionally, the air flow provides a ventilation system that provides enhanced breathing capabilities over a standard mask with simple holes. This ventilation is especially important when wearing in extreme heat or when worn by someone with asthma.

Figure 19:
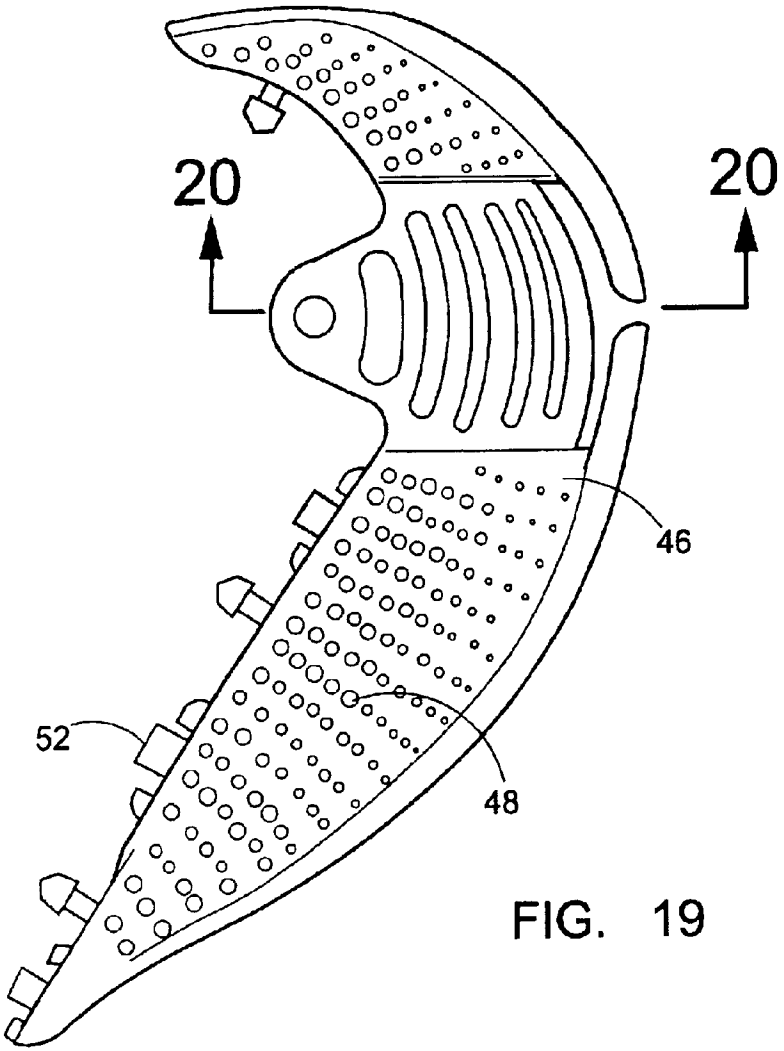
FIG. 19 is a side view of the ear portion of the mask of the present invention.

The ear portion 46 of the mask 40 is designed to cover and protect the ear area as shown in FIG. 19. The ear portion 46 is designed to attach to the main portion 44 shown in FIG. 13 through a plurality of cooperating parts 52 that attach the ear portion 46 to the main portion 44. It should be understood that any system of cooperating parts could be used in the present invention to secure the ear portion 46 and main portion 44 together. The cooperating parts may be designed as described in the preferred embodiment or substituted by any means for attaching two parts, including: locking tabs, screws, peg and hole fasteners, snaps, or any other known fastening means. More preferably, the cooperating parts should be mating parts, defined by elements that are dimensioned and arranged to fit together and release using hand manipulation only, that is, without the need for a tool or additional object to aid in the securing and releasing of the attachment. The suggested, but not exclusive, method of attaching the main portion to the ear portion follows: moisten the cooperating parts with water; starting at the top and working down, attach the cooperating parts together one by one.

Figure 20:
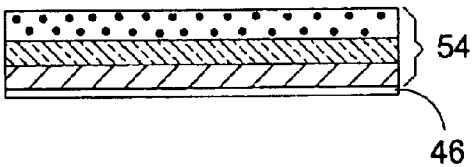
FIG. 20 is a cross sectional view of the ear portion taken along line 5—5 of FIG. 17.

It should be noted that the ear portion includes vents 48 of varying sizes. The portion that covers the ear of the person typically has vents that are designed to allow air and additional sound through the material so that the person wearing the mask has acute hearing abilities in his or her surrounding environment. A cross-section of the ear portion 52 is shown in FIG. 20 and exemplifies foam 54 attached to the inner side of the ear portion, similar to the foam described above on the inner side of the goggle frame.

Figure 21:
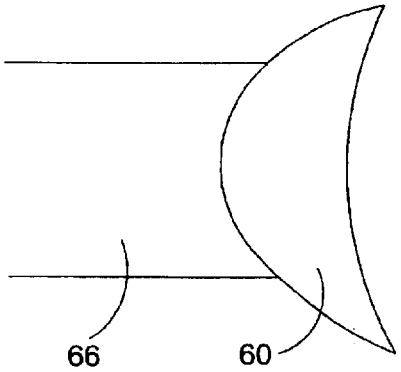
FIG. 21 is a side view of the strap securing member of the present invention.
Figure 22:
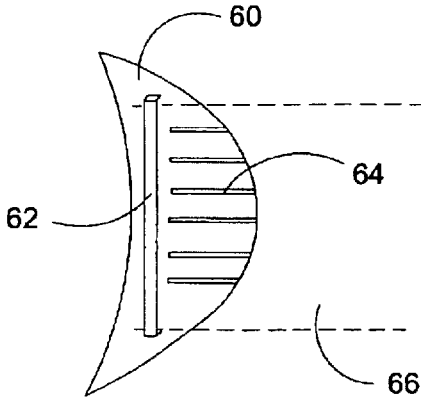
FIG. 22 is the opposite side view of the strap securing member shown in FIG. 19.

The side of the protective mask system as shown in FIG. 2, exemplifies a strap securing member 60 and a strap 66. FIG. 21 and FIG. 22 show a front and back view of the strap securing member respectively. It should be noted that the strap securing member 60 could be formed integrally with the frame 10 or may be formed as a separate member that mates with the frame 10 through cooperating parts in a manner similar to other cooperating parts described with this invention. The back side of the strap securing member 60 includes a strap holding means 62 dimensioned and arranged to receive the strap 66 therein. A plurality of blades 64, oriented substantially parallel to the longitudinal axis of the strap, are formed on the back side of the strap securing member 60 adjacent the strap holding means 62 for holding the strap in place without slippage up or down on the strap securing member.

With reference to FIGS. 23–27, an embodiment of an audible timer 100 for the goggle and mask system will now be described. The audible timer 100 may be used, for example, to audibly remind a user of the amount of time remaining during a round of paintball. For example, if a round of paintball lasts 20 minutes, the audible timer 100 may be activated at the start of the round. The audible timer 100 may then indicate the time in the round remaining at different time intervals.

Figure 25:
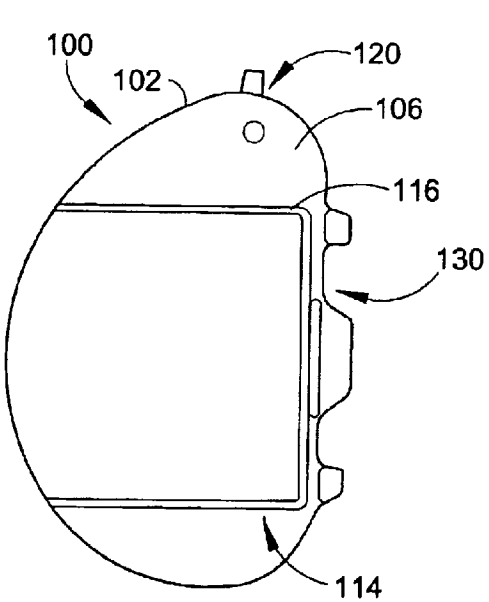
FIG. 25 is a rear elevational view of the audible timer illustrated in FIG. 23.
Figure 24:
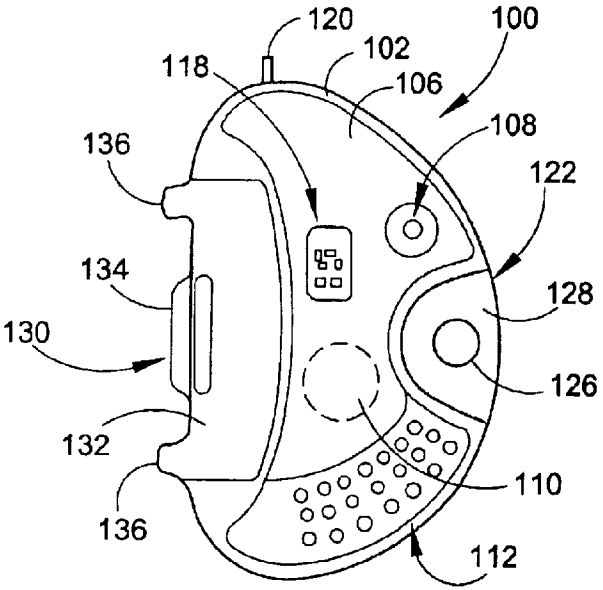
FIG. 24 is a front elevational view of the audible timer illustrated in FIG. 23, shown separate from the mask.
Figure 26:
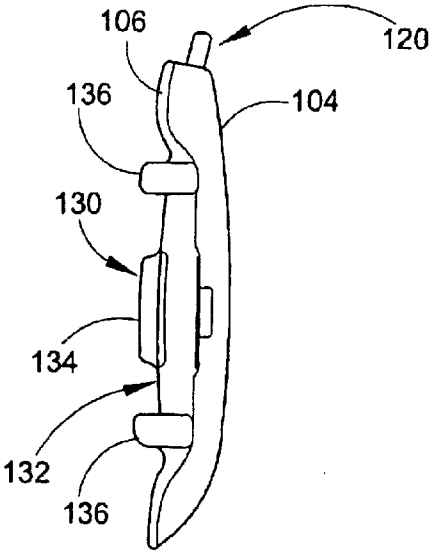
FIG. 26 is an end view of the audible timer illustrated in FIG. 23.
Figure 27:
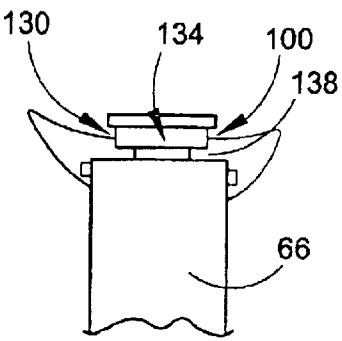
FIG. 27 is an alternative end view of the audible timer, shown connected to a strap of the mask via a strap clip.

The audible timer 100 includes a generally ear-shaped housing 102. The housing 102 includes a front face 104 (FIG. 24) and a rear face 106 (FIG. 25). The housing 102 houses suitable electronics for providing the functions of the audible timer 100 described herein. For example, the electronics may include a clock/timer unit that is activated/reset with a recessed timer button 108. Upon activation of the button 108, the clock/timer unit counts down from a predetermined time duration (e.g., 20 minutes, 30 minutes). Although not shown, the audible timer 100 may include input for selecting the desired timer duration or predetermined time. A speaker 110 may be in communication with the electronics for emitting audible reminders of the time remaining in a round at different predetermined time intervals (e.g., "15 minutes remaining", "10 minutes remaining", "5 minutes remaining", "1 minute remaining"). The audible reminder may be emitted by the speaker 110 through a speaker grid 112 of the housing 102. The audible timer 100 may be powered by one or more power sources (e.g., batteries) located within a power source compartment 114. A removable rear cover 116 for the power source compartment 114 may be located along the rear face 106 of the housing 102. A display 118 on the front face 104 of the housing 102 may include one or more LEDs for indicating the status (e.g., on/off) of the audible timer 100 and the amount of predetermined time or desired time of duration. An on/off button 120 may be used to activate or deactivate the audible timer 100.

Figure 23:
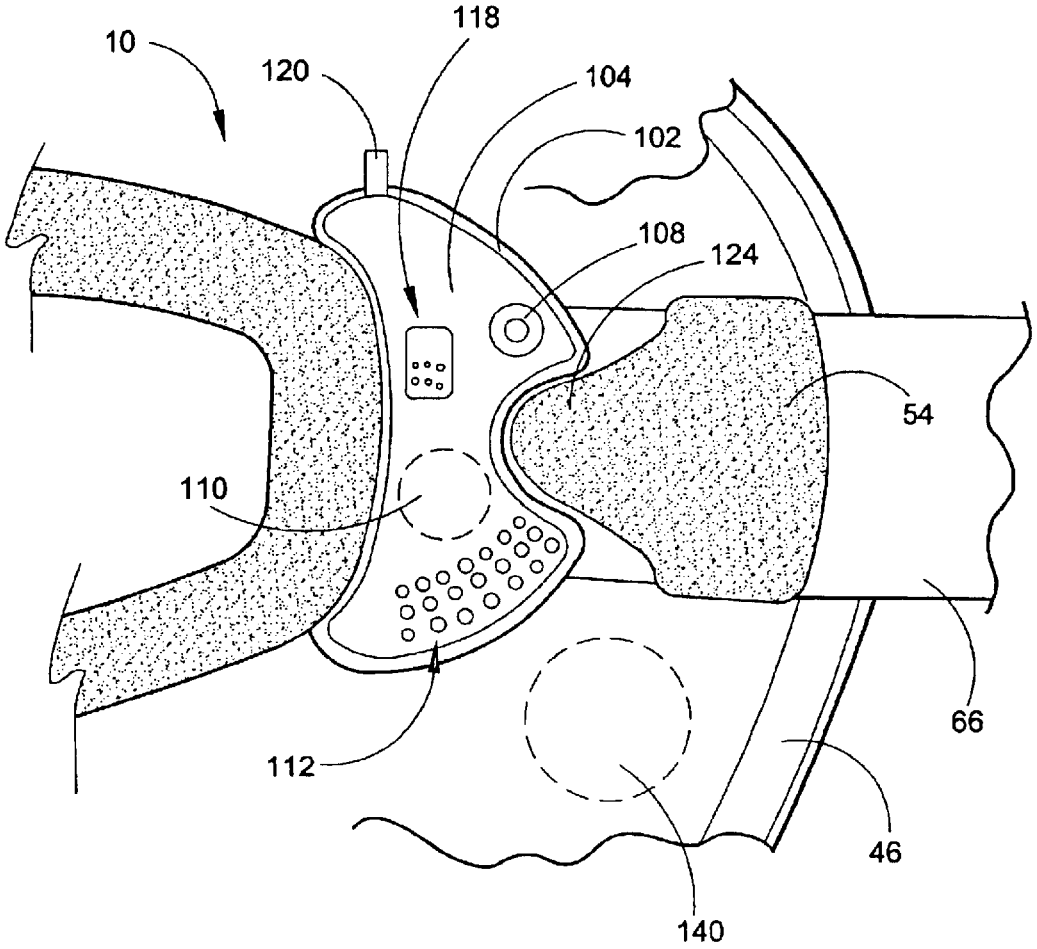
FIG. 23 is a front elevational view of an embodiment of an audible timer, shown attached to an inner side of the mask.

The housing 102 may include a recessed incurved area 122 that receives a portion 124 (FIG. 23) of the foam 54 when the audible timer 100 is attached to the inner side of the goggle and mask system. A cylindrical member 126 extends outward from a ledge 128 of the recessed area 122. When the audible timer 100 is positioned as shown in FIG. 23, an underside of the foam portion 124 abuts a top of the cylindrical member 126.

The housing 102 may also include a connection mechanism 130 for connecting the audible timer 100 to the goggle and mask system. The connection mechanism 130 may include a recessed member 132 that terminates in a generally trapezoidal-shaped lower tab 134, which is flanked by opposite protruding ears 136. When the audible timer 100 is positioned as shown in FIG. 23, the tab 132 may fit in a gap or slot 138 (FIG. 27) between an end of the mask 10 and a strap clip to maintain the audible timer 100 in position. In alternative embodiments, other connection mechanisms may be used for connecting the audible timer 100 to the goggle and mask system, only the goggles, only the mask, or only the user's body (e.g., in or around the user's ear, around the user's neck).

The audible timer 100 will now be described in use in conjunction with the periodic counting down of time remaining during a round of paintball play. It should be noted, the audible timer 100 may be used to audibly indicate to a user time-related information for other purposes than reminding a user of the time remaining during a round of paintball play. The user attaches the audible timer 100 to the goggle and mask system at a location adjacent to a user's ear 140 (FIG. 23), near a junction where the goggles 10 and strap 60 join. In alternative embodiments, the audible timer 100 may be positioned at other locations as long as the sound emitted from the audible timer 100 is discernible by the user. The tab 132 is inserted in the slot 138 (FIG. 27) between the end of the mask 10 and the strap clip to maintain the audible timer 100 in position. The goggle and mask system may include a hole that the on/off button 120 of the audible timer 100 protrudes through. The user fits the cylindrical member 126 and the ledge 128 of the recessed area 122 under the foam portion 124 to further maintain the audible timer 100 in position. The user activates the audible timer 100 by pressing the on/off button 120. When the audible timer 100 is turned on, the LED(s) of the display 118 may illuminate. At the beginning of a round of paintball, the user presses the reset button 108 to start the timer. The user may press the reset button before putting on the goggle and mask system or with the goggle and mask system on the user's head. The timer counts down the predetermined time period and at predetermined periods of time, the electronics cause the speaker 110 to audibly indicate the amount of time remaining in the round. In an alternative embodiment, the electronics may cause the speaker 110 to indicate the amount of time that has lapsed at predetermined periods of time. The timer stops counting when the predetermined time period of the round of paintball has been counted down. While the timer is counting down or after the timer has counted down the predetermined time period, pressing the reset button 108 may reset the timer to start the countdown again. The user turns the audible timer 100 off by pressing the on/off button 120, which may cause the LED(s) to turn off. Although the invention has been described above with respect to particular embodiments, it will be evident to a person skilled in the art that it may be modified and refined in various ways. It is therefore wished to have it understood that the present invention should not be limited in scope, except by the terms of the following claims.

What is claimed is:

1. A goggle and mask system comprising:

a goggle portion comprising, a goggle frame having an inner side adapted to be worn around the eyes of a person's face and an outer side opposite said inner side, front and rear gutters formed in the inner circumference of said goggle frame between said inner and outer sides of said frame, a plurality of air holes in said rear gutter defining ribs connecting the inner walls of said rear gutter, a lens having a plurality of curvatures and disposed in said front gutter, the lens having a convex side and a concave side, means for securing the lens within said front gutter, said means for securing the lens formed within the front gutter and on the periphery of the lens;

a mask portion comprising, a mask frame shaped to protect the nose,mouth,chin, jaws and temples of a person's face, the mask frame having a plurality of vents, and a plurality of vane clusters, each of vane clusters being positioned within one of the plurality of vents of matching perimeter and being recessed in relation to the vent;

means for securing the mask formed within the goggle portion and the mask portion for securing the mask portion to the goggle portion; and means for securing a strap to the goggle frame.

2. The goggle and mask system of claim 1, wherein said goggle frame is formed from a tear resistant polyurethane material.

3. The goggle and mask system of claim 1, further comprising a foam frame attached to the inner side of the goggle frame, the foam frame comprising a plurality of foam layers of different densities.

4. The goggle and mask system of claim 1 wherein said means for securing the lens comprise:

a plurality of tab retention holes in said front gutter; and a plurality of retention tabs formed on the periphery of said lens, the plurality of retention tabs being hook-shaped and extending outwards of the convex side of the lens in positions matching the plurality of tab retention holes, each of the hook-shaped retention tabs having a stem portion connected to the lens and an end portion extending from the stem portion, wherein the end portion of each of the plurality of retention tabs is inserted into one of the second plurality of openings, each end portion exiting the opening to a position flush with the mask frame.

5. The goggle and mask system of claim 4, wherein:

the plurality of tab retention holes includes a central stability tab retention opening at the upper central portion of the goggle frame, the front gutter being formed substantially around the entire circumference of the goggle frame and converging into said central stability tab retention opening, said central stability tab retention opening being dimensioned larger than the holes of said plurality of tab retention openings; and said plurality of retention tabs includes a central stability tab located at the upper central portion of the lens periphery and dimensioned to be larger than other tabs of said plurality of retention tabs, said central stability tab retention opening and said central stability tab being dimensioned and arranged to securely mate together.

6. The goggle and mask system of claim 4, wherein said plurality of retention tabs includes at least eleven retention tabs.

7. The goggle and mask system of claim 1, wherein said lens is formed from a polycarbonate material.

8. The goggle and mask system of claim 1, wherein the vane clusters in the vents covering the nose and mouth regions are oriented to project forward from the face, and the vane clusters in the remaining vents are oriented to project sideways.

9. The goggle and mask system of claim 1, wherein the mask portion further comprises:

a. at least one ear portion shaped to protect the ears; and b. means for securing said ear portion to said main portion.

10. The goggle and mask system of claim 9, wherein said means for securing said ear portion to said mask portion comprise a plurality of cooperating parts on said ear portion and said mask portion adapted to mate together.

11. The goggle and mask system of claim 9, further comprising foam on an inner side of said ear portion.

12. The goggle and mask system of claim 11, wherein the foam comprises a plurality of foam layers of different densities.

13. The goggle and mask system of claim 9, further comprising a timer removably attached to the ear side of the at least one ear portion, the timer being capable of emitting audible time signals.

14. The goggle and mask system of claim 9, wherein the at least one ear portion comprises a plurality of vents enabling transmission of air and sound signals through the at least one ear portion.

15. The goggle and mask system of claim 1, wherein the mask portion is formed from a resilient, flexible material.

16. The goggle and mask system of claim 1, further comprising a visor secured to said goggle frame.

17. The goggle and mask system of claim 1 further comprising a strap connected to the means for securing a strap and adapted to be fit around the head of a person.

18. The goggle and mask system of claim 1, wherein the means for securing a strap comprise a member removably attached to the goggle frame, the member comprising one or more blades extending from the member side facing the strap, the blades being oriented substantially parallel to the longitudinal axis of the strap and preventing slippage of the strap.

19. The goggle and mask system of claim 1, wherein the plurality of vanes clusters are connected by bridge elements to form one or more vane sheets, the one or more vanes sheets being inserted into the mask frame to form a matching union of the plurality of vane clusters with the plurality of vents.

* * * * *